US008666103B2

(12) United States Patent
Hsieh

(10) Patent No.: US 8,666,103 B2
(45) Date of Patent: Mar. 4, 2014

(54) WATERPROOF PILLOW WITH AUDIO UNIT

(75) Inventor: Chung-hsin Hsieh, Taipei (TW)

(73) Assignee: Dartpoint Tech Co., Ltd., Taipei (TW)

( * ) Notice: Subject to any disclaimer, the term of this patent is extended or adjusted under 35 U.S.C. 154(b) by 459 days.

(21) Appl. No.: 13/107,868

(22) Filed: May 13, 2011

(65) Prior Publication Data

US 2011/0280429 A1 Nov. 17, 2011

(30) Foreign Application Priority Data

May 14, 2010 (TW) ..... 99115583 A

(51) Int. Cl.
*H04R 9/06* (2006.01)

(52) U.S. Cl.
USPC ..... 381/334; 5/636; 4/575.1

(58) Field of Classification Search
USPC ..... 381/301, 333, 334, 386, 309, 370, 388, 381/87, 332; 455/464, 509, 199.1, 63.3, 455/3.01, 3.04; 5/636, 639, 904; 4/575.1, 4/499
See application file for complete search history.

(56) References Cited

U.S. PATENT DOCUMENTS

| | | | | |
|---|---|---|---|---|
| 5,781,864 | A * | 7/1998 | Reudink | 455/560 |
| 5,892,503 | A * | 4/1999 | Kim | 345/168 |
| 2001/0006892 | A1* | 7/2001 | Barnett et al. | 455/434 |
| 2001/0015918 | A1* | 8/2001 | Bhatnagar | 365/200 |
| 2005/0202788 | A1* | 9/2005 | Vinson et al. | 455/90.3 |
| 2006/0223467 | A1* | 10/2006 | Mason | 455/185.1 |
| 2007/0240258 | A1 | 10/2007 | Roberts et al. | |
| 2007/0253591 | A1 | 11/2007 | Popilek et al. | |
| 2008/0031475 | A1* | 2/2008 | Goldstein | 381/151 |
| 2008/0161025 | A1* | 7/2008 | Imai | 455/464 |
| 2009/0054020 | A1* | 2/2009 | Mason | 455/127.5 |
| 2009/0147965 | A1 | 6/2009 | Kuo | |
| 2009/0285421 | A1* | 11/2009 | Greene et al. | 381/309 |

FOREIGN PATENT DOCUMENTS

| | | | |
|---|---|---|---|
| CN | 101093610 | A | 12/2007 |
| CN | 201290520 | Y | 8/2009 |

OTHER PUBLICATIONS

Unknown, "Regarding to the Use of Bluetooth Earphone", May 16, 2009, pp. 3-5, http://www.mobile01.com/topicdetail.php?f=180&t=1057366&last=12075546, Taiwan.

* cited by examiner

*Primary Examiner* — Vivian Chin
*Assistant Examiner* — Friedrich W Fahnert
(74) *Attorney, Agent, or Firm* — Cheng-Ju Chiang

(57) ABSTRACT

A waterproof pillow with audio unit is described. The waterproof pillow with audio unit includes a waterproof pillow, a sound unit and a remote control unit. Either the sound unit scans a plurality of audio devices for identifying the audio devices or the audio devices respectively scan the sound unit for identifying the sound unit to establish the communication links between the sound unit and audio devices. The sound unit then utilizes a switch unit to switch for selecting one of the audio devices. An audio output device is used to output the audio output of the selected audio device. The remote control unit controls the sound unit for selecting the musical sound of the audio devices served as the audio output. The remote control unit further adjusts the volume of the audio output.

16 Claims, 2 Drawing Sheets

WATERPROOF PILLOW WITH AUDIO UNIT

FIELD OF THE INVENTION

The present invention relates to a waterproof pillow, and more particularly relates to a waterproof pillow with audio unit, wherein a plurality of audio devices outside the bathroom are controlled by a wireless communication protocol, e.g. blue-tooth protocol, so that the user can listen to musical sound played by the selected audio device while the user pillows on the waterproof pillow with audio unit, and while a mobile phone served as an audio device rings, the user can instantly talk over the mobile phone.

BACKGROUND OF THE INVENTION

Since it is necessary to conveniently listen to musical sound when bathing or making a period of SPA in the bathroom for the user, sound equipment is placed in the bathroom. The sound equipment is located far from the bathtub for preventing the sound equipment from moisture resulting in damaging the electrical circuits of the sound equipment. However, even if the sound equipment is located in dry position far from the bathtub, the sound equipment is still subjected to moisture so that the sound equipment is severely damaged and its life-span is reduced. Conventionally, although the sound equipment located in the bathroom can be controlled remotely, however, a play list played by the sound equipment cannot be inquired and thus it is inconvenient. Specifically, when the mobile phone rings during bathing, the incoming call cannot be received by the user in time when the user may lose an important phone call. Furthermore, if there is a need to bath for a long time, it is required to prepare waterproof pillow for supporting the head and neck of the user and listen to music for relaxing the body and the spirit of the user. However, the user will stand up to select the play list of the sound equipment inconveniently so that the user cannot be relaxed and let the head and neck released. Consequently, there is a need to develop a novel waterproof pillow to solve the aforementioned problems.

SUMMARY OF THE INVENTION

One objective of the present invention is to provide a waterproof pillow with audio unit to allow the user to easily listen to the musical sound and to receive the incoming call in time while the user comfortably lies on the waterproof pillow by controlling the audio devices outside the bathroom based on wireless communication protocol, such as blue-tooth protocol.

According to the above objective, the present invention sets forth a waterproof pillow with audio unit. The waterproof pillow with audio unit includes a waterproof pillow body, a sound unit and a remote control unit. The waterproof pillow with audio unit establishes a communication link to the audio devices by the sound unit. The remote control unit remotely controls the sound unit. The audio devices include a plurality of first type of audio devices and a plurality of second type of audio devices. For example, the first type of audio devices includes a MPEG-1 audio layer 3 (MP3) player and the IPOD player, and the second type of audio devices are a notebook computer and a mobile phone. The waterproof pillow body has the waterproof function and the sound unit connected to the waterproof pillow body. In one embodiment, the waterproof pillow body is detachable from or attachable to the sound unit for either combing the waterproof pillow body with the sound unit or separating the waterproof pillow body from the sound unit. For example, the waterproof pillow body is movably buckled to the sound unit. In another embodiment, the waterproof pillow body is fastened to the sound unit for combing the waterproof pillow body with the sound unit. That is, the waterproof pillow body is securely fixed to the sound unit.

The controller controls operation procedures between the waterproof pillow with audio unit and the audio devices. The device-scanning module is used to scan the first type of audio devices for identifying the first type of audio devices to establish the communication links between the sound unit and the first type of audio devices. The controller controls the switch unit for selecting one of the audio devices by the switch unit and for playing a musical sound of the selected audio device by the controller. The controller stops or pauses to play the musical sound of the selected audio device when the switch unit selects another audio device to allow the switch unit to switch from the selected audio device to another selected audio device for playing another musical sound of another selected audio device.

In one embodiment, the device-scanning module scans the first type of audio devices for identifying the first type of audio devices to establish the communication links between the sound unit and the first type of audio devices and for controlling the first type of audio devices to play the musical sound. For example, the device-scanning module of the waterproof pillow with audio unit utilizes the second wireless module to directly scan the first wireless module of the MP3 player and the IPOD player so that the communication link either between the waterproof pillow with audio unit and the MP3 player or between the waterproof pillow with audio unit and IPOD player is constructed. Further, the controller controls the first type of audio devices to play the musical sound.

In another embodiment, the second type of audio devices utilizes the first wireless module to scan and search the sound unit so that the second type of audio devices identifies the sound unit to establish the communication links between the sound unit and the second type of audio devices and to control the second type of audio devices to play the musical sound. For example, the mobile phone and the notebook computer directly scan the waterproof pillow with audio unit so that the communication link either between the mobile phone and the waterproof pillow with audio unit or between the notebook computer and the waterproof pillow with audio unit is constructed.

When one of the MP3 player, the IPOD player, the mobile phone and the notebook computer respectively of the audio devices plays the musical sound and the mobile phone rings, the sound unit (or the remote control unit) stops or pauses to play the musical sound of the selected audio device and the switch unit switches from the musical playing mode of the selected audio device to a talk mode of the mobile phone for talking over the mobile phone. When the talk mode is over, the switch unit switches from the talk mode of the mobile phone back to the musical playing mode of the selected audio device for continuously playing the musical sound.

The audio input device inputs an audio input of the waterproof pillow with audio unit to the audio devices. Specifically, when the mobile phone rings, a communication device of the mobile phone communicates with the sound unit via the first wireless module to establish the talk mode so that the user utilizes the audio input device of the sound unit to talk with a calling party. The audio input device is a microphone for acquiring the audio content of the user. The audio output device outputs an audio output of the selected audio device to the waterproof pillow with audio unit. The audio output device is a waterproof speaker disposed on the lateral sides of the waterproof pillow body. The microphone is disposed in one of the lateral sides of the waterproof pillow body. The communication unit is coupled with the first wireless module of the audio device to establish a wireless communication link between the sound unit and the audio devices. In one embodiment, the second wireless module of the communication unit communicates with the first wireless module according to blue-tooth protocol for establishing the wireless communication link wherein the blue-tooth protocol supports the protocols including Advanced Audio Distribution Profile (A2DP), Audio/Video Remote Control Profile (AVRCP), Headset Profile (HSP) and Hands-Free Profile (HFP). The transceiving module of the communication unit remotely controls the sound unit. In one case, the transceiving module is coupled with the remote control unit according to a wireless protocol which is a radio frequency (RF) communication protocol. In another case, the transceiving module is coupled with the remote control unit according to a wire communication by connecting the transceiving module to the remote control unit via a cable.

The memory unit stores a control program of the waterproof pillow with audio unit and the audio devices. The first display unit displays the wireless communication link of the first wireless module and the second wireless module between the sound unit and the audio devices, displays the communication link (e.g. wireless or wire communication) between the transceiving module of the sound unit and the remote control unit, and displays a power status of the sound unit. In other words, the user utilizes the first display unit to check whether the waterproof pillow with audio unit is connected to the audio device and the power on/off status of the waterproof pillow with audio unit.

The remote control unit remotely controls the sound unit for selecting the musical sound of the selected audio device as the audio output and adjusting the volume of the audio output. When one of the MP3 player, the IPOD player, the mobile phone and the notebook computer respectively plays the musical sound and the mobile phone rings, the switch unit switches from the musical playing mode of the selected audio device to a talk mode of the mobile phone for talking over the mobile phone and the remote control unit stops or pauses to play the musical sound of the selected audio device. When the talk mode is over, the remote control unit ends the talk mode.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
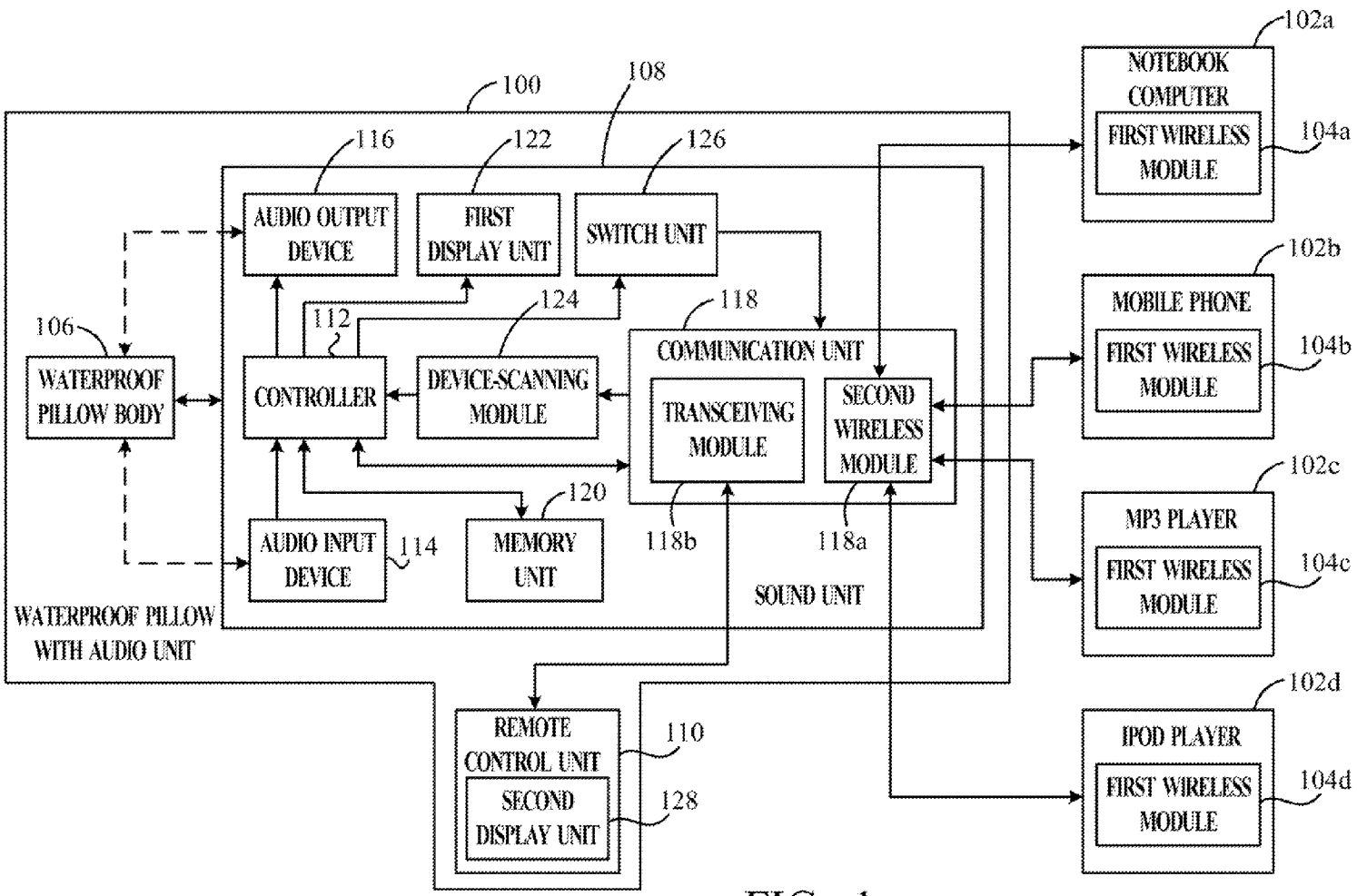
FIG. 1 is a schematic function block diagram of a waterproof pillow with audio unit according to one embodiment of the present invention.

FIG. 1 is a schematic function block diagram of a waterproof pillow with audio unit 100 according to one embodiment of the present invention. The waterproof pillow with audio unit 100 is applicable to a wet environment. The waterproof pillow with audio unit 100 establishes a communication link to a plurality of audio devices (102*a* through 102*d*) by a first wireless module (104*a* through 104*d*) of each audio device (102*a* through 102*d*) so that the waterproof pillow with audio unit 100 selectively transmits audio content to the audio devices (102*a* through 102*d*) or receives the audio content from the audio devices (102*a* through 102*d*). The waterproof pillow with audio unit 100 includes a waterproof pillow body 106, a sound unit 108 and a remote control unit 110. The waterproof pillow with audio unit 100 establishes a communication link to the audio devices (102*a* through 102*d*) by the sound unit 108. The remote control unit 110 remotely controls the sound unit 108. The waterproof pillow body 106 has the waterproof function and the sound unit 108 movably connected to the waterproof pillow body 106. In one embodiment, the waterproof pillow body 106 is detachable from or attachable to the sound unit 108 for either combing the waterproof pillow body 106 with the sound unit 108 or separating the waterproof pillow body 106 from the sound unit 108. For example, the waterproof pillow body 106 is movably buckled to the sound unit 108. In another embodiment, the waterproof pillow body 106 is fastened to the sound unit 108 for combing the waterproof pillow body 106 with the sound unit 108. That is, the waterproof pillow body 106 is securely fixed to the sound unit 108.

The audio devices (102*a* through 102*d*) include a plurality of first type of audio devices (102*c*, 102*d*) and a plurality of second type of audio devices (102*a*, 102*b*). For example, the first type of audio devices (102*c*, 102*d*) are a MPEG-1 audio layer 3 (MP3) player 102*c* and the IPOD player 102*d*, and the second type of audio devices (102*a*, 102*b*) are a notebook computer 102*a* and a mobile phone 102*b*. The MP3 player 102*c* is an digital player served as the digital audio encoded function and the IPOD player 102*d* is a digital audio encoded player which is a portable digital multimedia player designed by Apple Inc. The audio devices (102*a* through 102*d*) may be arbitrary type of sound equipment. The waterproof pillow with audio unit 100 is applicable to a moist environment, i.e., a bathroom or a costal beach.

The sound unit 108 has a controller 112, an audio input device 114, an audio output device 116, a communication unit 118, a memory unit 120, a first display unit 122, a device-scanning module 124 and a switch unit 126. The audio input device 114, an audio output device 116, a communication unit 118, a memory unit 120, and a first display unit 122 are coupled with the controller 112. The device-scanning module 124 is coupled between the controller 112 and the communication unit 118. The switch unit 126 is coupled between the controller 112 and the communication unit 118. The communication unit 118 includes a second wireless module 118*a* and a transceiving module 118*b*. The second wireless module 118*a* is coupled with each first wireless module (104*a* through 104*d*) and the controller 112. The transceiving module 118*b* is coupled with the remote control unit 110.

The controller 112 controls operation procedures between the waterproof pillow with audio unit 100 and the audio devices (102*a* through 102*d*). The device-scanning module 124 is used to scan the first type of audio devices (102*c*, 102*d*) for identifying the first type of audio devices (102*c*, 102*d*) to establish the communication links between the sound unit 108 and the first type of audio devices (102*c*, 102*d*). For example, the device-scanning module 124 is composed of software program, firmware program, and/or hardware circuits for automatically searching the audio devices (102*a* through 102*d*). The controller 112 controls the switch unit 126 for selecting one of the audio devices (102*a* through 102*d*) by the switch unit 126 and for playing a musical sound of the selected audio device (102*a* through 102*d*) by the controller 112. The controller 112 stops or pauses to play the musical sound of the selected audio device (102*a* through 102*d*) when the switch unit 126 selects another audio device (102*a* through 102*d*) to allow the switch unit 126 to switch from the selected audio device (102*a* through 102*d*) to another selected audio device (102*a* through 102*d*) for playing another musical sound of another selected audio device (102*a* through 102*d*). For example, the switch unit 126 is software program, firmware program, and/or hardware circuits.

In one embodiment, the device-scanning module 124 scans the first type of audio devices (102*c*, 102*d*) for identifying the first type of audio devices (102*c*, 102*d*) to establish the communication links between the sound unit 108 and the first type of audio devices (102*c*, 102*d*) and for controlling the first type of audio devices (102*c*, 102*d*) to play the musical sound. For example, the device-scanning module 124 of the waterproof pillow with audio unit 100 utilizes the second wireless module 118*a* to directly scan the first wireless module (104*c*, 104*d*) of the MP3 player and the IPOD player so that the communication link either between the waterproof pillow with audio unit 100 and the MP3 player or between the waterproof pillow with audio unit 100 and IPOD player is constructed. Further, the controller 112 controls the first type of audio devices (102*c*, 102*d*) to play the musical sound wherein the waterproof pillow with audio unit 100 is a master device and the MP3 player and IPOD player are the slave devices.

In another embodiment, the second type of audio devices (102*a*, 102*b*) utilizes the first wireless module (104*a*, 104*b*) to scan and search the sound unit 108 so that the second type of audio devices (102*a*, 102*b*) identifies the sound unit 108 to establish the communication links between the sound unit 108 and the second type of audio devices (102*a*, 102*b*) and to control the second type of audio devices (102*a*, 102*b*) to play the musical sound. For example, the mobile phone 102*b* and the notebook computer 102*a* directly scan the waterproof pillow with audio unit 100 so that the communication link either between the mobile phone 102*b* and the waterproof pillow with audio unit 100 or between the notebook computer 102*a* and the waterproof pillow with audio unit 100 is constructed wherein either the mobile phone 102*b* or the notebook computer 102*a* is a master device and the waterproof pillow with audio unit 100 is a slave device.

When one of the MP3 player 102*c*, the IPOD player 102*d*, the mobile phone 102*b* and the notebook computer 102*a* respectively of the audio devices (102*a* through 102*d*) plays the musical sound and the mobile phone 102*b* rings, the sound unit 108 (or the remote control unit 110) stops or pauses to play the musical sound of the selected audio device and the switch unit 126 switches from the musical playing mode of the selected audio device to a talk mode of the mobile phone 102*b* for talking over the mobile phone. When the talk mode is over, the switch unit 126 switches from the talk mode of the mobile phone 102*b* back to the musical playing mode of the selected audio device for continuously playing the musical sound. Specifically, when the mobile phone 102*b* rings, a communication device (not labeled) of the mobile phone 102*b* communicates with the sound unit 108 via the first wireless module (104*a*, 104*b*) to establish the talk mode so that the user utilizes the audio input device 114 of the sound unit 108 to talk with a calling party.

In one preferred embodiment, the sound unit 108 utilizes the device-scanning module 124 to identify one (such as MP3 player 102*c*) of the first type of audio devices (102*c*, 102*d*) and one (such as mobile phone 102*b*) of the second type of audio devices (102*a*, 102*b*) identifies the sound unit 108 so that controller 112 controls the switch unit 126 to switch the identified first type of audio device (102*c*, 102*d*) and the identified second type of audio device (102*a*, 102*b*).

The audio input device 114 inputs an audio input of the waterproof pillow with audio unit 100 to the audio devices (102*a* through 102*d*). The audio input device 114 is a microphone for acquiring the audio content of the user. The audio output device 116 outputs an audio output of the selected audio device (102*a* through 102*d*) to the waterproof pillow with audio unit 100. The audio output device 116 is a waterproof speaker for playing the musical sound from the audio devices (102*a* through 102*d*). For example, when the MP3 player 102*c* is selected by the sound unit 108, the MP3 player plays the musical sound. In one embodiment, the waterproof speaker is disposed on the lateral sides of the waterproof pillow body 106 for easily receiving and playing the audio content from the (102*a* through 102*d*). The microphone is disposed in one of the lateral sides of the waterproof pillow body 106 for acquiring and transmitting the audio content of the user. The communication unit 118 coupled with each first wireless module (104*a* through 104*d*) of each audio devices (102*a* through 102*d*) provides a communication interface between the audio devices (102*a* through 102*d*) and the sound unit 108.

In the communication unit 118, the second wireless module 118*a* establishes a wireless communication link between the sound unit 108 and the audio devices (102*a* through 102*d*). In one embodiment, the second wireless module 118*a* of the communication unit 118 communicates with the first wireless module (104*a*, 104*b*) according to blue-tooth protocol for establishing the wireless communication link wherein the blue-tooth protocol supports the protocols including Advanced Audio Distribution Profile (A2DP), Audio/Video Remote Control Profile (AVRCP), Headset Profile (HSP) and Hands-Free Profile (HFP). The transceiving module 118*b* of the communication unit 118 remotely controls the sound unit 108. In one case, the transceiving module 118*b* is coupled with the remote control unit 110 according to a wireless protocol which is a radio frequency (RF) communication protocol. In another case, the transceiving module 118*b* is coupled with the remote control unit 110 according to a wire communication by connecting the transceiving module 118*b* to the remote control unit 110 via a cable.

The memory unit 120 stores a control program of the waterproof pillow with audio unit 100 and the audio devices (102*a* through 102*d*). For example, the memory unit 120 is Electrically Erasable Programmable Read-Only Memory (EEPROM) or flash memory.

The first display unit displays the wireless communication link of the first wireless module (104*a* through 104*d*) and the second wireless module 118*a* between the sound unit 108 and the audio devices (102*a* through 102*d*), displays the communication link between the transceiving module 118*b* of the sound unit and the remote control unit 110, and displays a power status of the sound unit 108. In other words, the user utilizes the first display unit 122 to check whether the waterproof pillow with audio unit 100 is connected to the audio device (102*a* through 102*d*) and the power on/off status of the waterproof pillow with audio unit 100. In addition, the first display unit 122 displays the play list, played by the sound unit 108, for conveniently viewing the current playing music list. The first display unit 122 may be display panel composed of light emitter diode (LED), LED indicator, and/or LCD (liquid crystal display). In one embodiment, the sound unit 108 simplifies the first display unit 122. When the sound unit 108 directly scans the audio devices (102*a* through 102*d*) and automatically establishes the wireless communication links to the audio devices (102*a* through 102*d*), a light indicator, e.g., LED status indicator, of the first display unit 122 can display the communication link and power status of the sound unit 108.

The remote control unit 110 remotely controls the sound unit 108 for selecting the musical sound of the selected audio device (102*a* through 102*d*) as the audio output and adjusting the volume of the audio output. That is, when the device-scanning module 124 scans and searches the audio device (102*a* through 102*d*), the remote control unit 110 selects one of the audio device (102*a* through 102*d*). The remote control unit 110 further includes a second display unit 128 for remotely displaying the wireless communication links of the first wireless module (104*a* through 104*d*) and the second wireless module 118*a* between the audio devices (102*a* through 102*d*) and the sound unit 108, remotely displaying the communication link between the transceiving module 118*b* of the sound unit 108 and the remote control unit 110, and remotely displaying a power status of the sound unit 108.

When one of the MP3 player 102*c*, the IPOD player 102*d*, the mobile phone 102*b* and the notebook computer 102*a* respectively plays the musical sound and the mobile phone 102*b* rings, the switch unit 126 switches from the musical playing mode of the selected audio device to a talk mode of the mobile phone 102*b* for talking over the mobile phone 102*b* and the remote control unit 110 stops or pauses to play the musical sound of the selected audio device (102*a* through 102*d*). When the talk mode is over, the remote control unit 110 ends the talk mode. Specifically, the mobile phone, MP3 player, IPOD player and the notebook computer stores the play list of the musical sound, the remote control unit 110 plays the play list through the blue-tooth protocol, and the remote control unit 110 selects a previous song or next song in the play list. In one preferred embodiment, the remote control unit 110 is plastic case for proofing against moisture.

According to above-mentioned descriptions, the waterproof pillow with audio unit 100 integrates the waterproof pillow to sound unit having wireless control protocol (such as audio equipment with blue-tooth) for bathing or SPA so that the user comfortably lies on the waterproof pillow with audio unit and easily listen to the musical sound. There is no need to stand up to select play list of the audio device for the user and it is quite convenient. Further, the sound unit 108 utilizes the device-scanning module 124 and the switch unit 124 for connecting the waterproof pillow with audio unit 100 with the audio devices (102*a* through 102*d*) according to wireless communication protocol and for selectively switching the talk mode of the mobile phone (if the mobile phone rings). Thus, it is not necessary to stand up for the user so that the user is capable of directly and conveniently talking over the audio input device 114 and audio output device 116.

Figure 2:
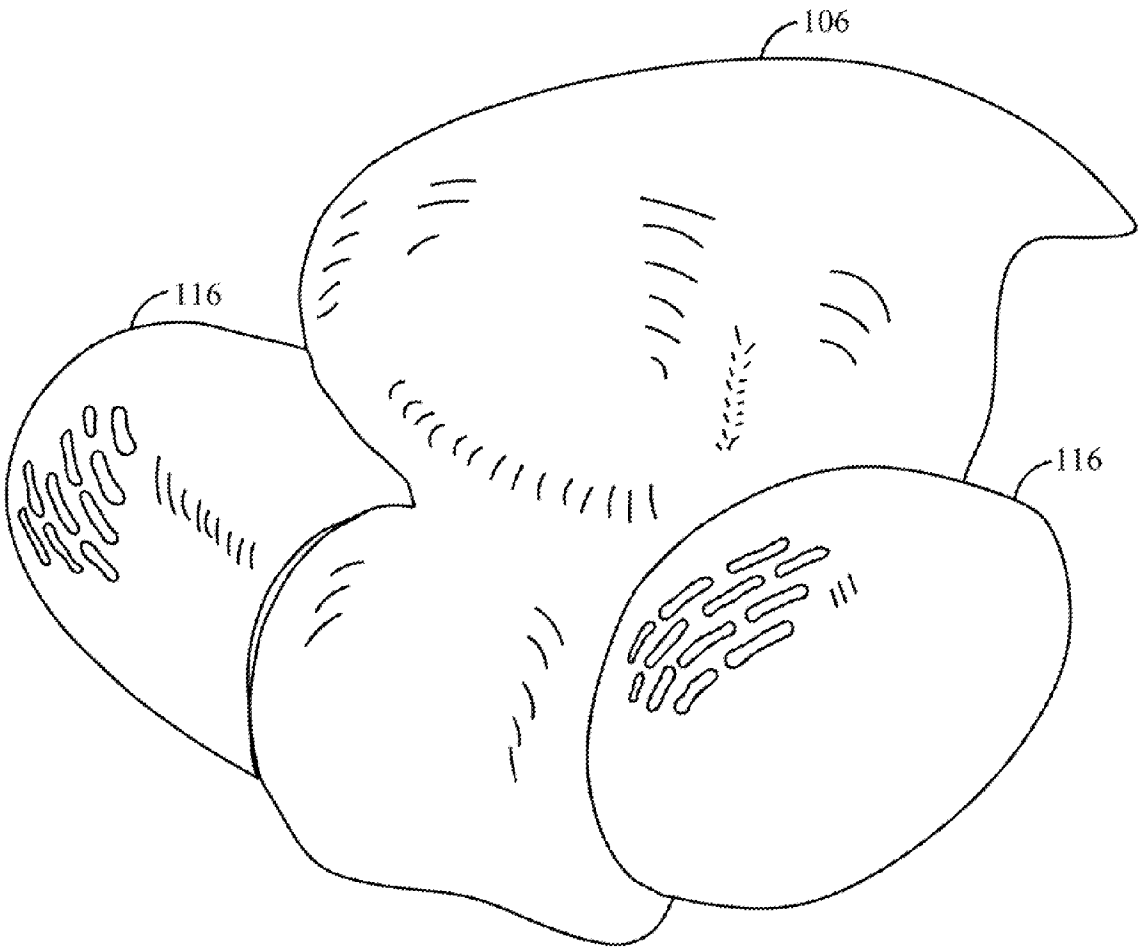
FIG. 2 is a schematic three-dimensional view of the waterproof pillow with audio unit shown in FIG. 1 according to one embodiment of the present invention.

Please refer to FIG. 1 and FIG. 2. FIG. 2 is a schematic three-dimensional view of the waterproof pillow with audio unit 100 shown in FIG. 1 according to one embodiment of the present invention. The waterproof pillow with audio unit 100 has a waterproof pillow body 106 and an audio output device 116. The audio output device 116 is disposed on the lateral sides of the waterproof pillow body 106, the sound unit 108 is disposed in the waterproof pillow body 106, and the waterproof pillow body 106 and the audio output device 116 have a plastic case for proofing against moisture, which are applicable to a wet environment, e.g., bathroom. That is, the waterproof pillow body 106 and the audio output device 116 is an integrated waterproof apparatus. In one embodiment, the waterproof speaker is disposed on the lateral sides of the waterproof pillow body 106 for easily broadcasting the voice (such as musical sound or received audio content of the mobile phone) by the power amplifier (not labeled). Moreover, the waterproof pillow with audio unit 100 is driven by supplying with battery or external power source.

It should be noted that the sound unit 108 can be served as a home audio when the waterproof pillow body 106 is detached from the sound unit 108. The second wireless module 118*a* of the sound unit 108 communicates with the first wireless module (104*a* through 104*d*) of the audio devices (102*a* through 102*d*) for playing musical sound.

According to the above-mentioned descriptions, the present invention provides a waterproof pillow with audio unit 100 to allow the user to easily listen to the musical sound and to receive the incoming call in time while the user comfortably lies on the waterproof pillow by controlling the audio devices outside the bathroom based on wireless communication protocol.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. A waterproof pillow with audio unit which is applicable to a wet environment, wherein the waterproof pillow with audio unit selectively transmits audio content to a plurality of audio devices or receives the audio content from the audio devices and the audio devices comprises a plurality of first type of audio devices and a plurality of second type of audio devices, and each of audio devices has a first wireless module, the waterproof pillow with audio unit comprising:

a waterproof pillow body;

a sound unit connected to the waterproof pillow body, the sound unit comprising:

a controller controlling operation procedures between the waterproof pillow with audio unit and the audio devices;

a device-scanning module, coupled with the controller, scanning the first type of audio devices for identifying the first type of audio devices to establish a plurality of communication links between the sound unit and the first type of audio devices;

a switch unit, coupled with the controller, allowing the controller to control the switch unit for selecting one of the audio devices and for playing a musical sound of the selected audio device by the controller, wherein the controller stops to play the musical sound of the selected audio device when the switch unit selects another audio device to allow the switch unit to switch from the selected audio device to another selected audio device for playing another musical sound of another selected audio device;

an audio input device, coupled with the controller, inputting an audio input of the waterproof pillow with audio unit to the audio devices;

an audio output device, coupled with the controller, outputting an audio output of the selected audio device; and a communication unit, coupled with each first wireless module of each audio devices, providing a communication interface between the audio devices and the sound unit, wherein the second type of audio devices scan the sound unit by the first wireless module for identifying the sound unit by using the second type of audio devices to establish the communication links between the sound unit and the second type of audio devices; and a remote control unit, coupled with the communication unit of the sound unit, controlling the sound unit remotely for selecting the musical sound of the selected audio device as the audio output and adjusting the volume of the audio output.

2. The waterproof pillow with audio unit of claim 1, wherein the waterproof pillow body is detachable from or attachable to the sound unit for either combing the waterproof pillow body with the sound unit or separating the waterproof pillow body from the sound unit.

3. The waterproof pillow with audio unit of claim 2, wherein the waterproof pillow body is movably buckled to the sound unit.

4. The waterproof pillow with audio unit of claim 1, wherein the waterproof pillow body is fastened to the sound unit for combing the waterproof pillow body with the sound unit.

5. The waterproof pillow with audio unit of claim 1, wherein the audio output device is a waterproof speaker disposed on the lateral sides of the waterproof pillow body and the audio input device is a microphone disposed in one of the lateral sides.

6. The waterproof pillow with audio unit of claim 1, wherein the communication unit further comprises:

a second wireless module, coupled with each of the first wireless module, establishing a wireless communication link between the sound unit and the audio devices; and a transceiving module, coupled with the remote control unit, remotely controlling the sound unit.

7. The waterproof pillow with audio unit of claim 6, wherein the second wireless module of the communication unit communicates with the first wireless modules based on a blue-tooth protocol for establishing the wireless communication link.

8. The waterproof pillow with audio unit of claim 6, wherein the transceiving module is coupled with the remote control unit according to a wireless protocol which is a radio frequency communication protocol.

9. The waterproof pillow with audio unit of claim 6, wherein the transceiving module is coupled with the remote control unit according to a wire communication by connecting the transceiving module to the remote control unit via a cable.

10. The waterproof pillow with audio unit of claim 6, wherein the sound unit further comprises:

a memory unit, coupled with the controller, storing a control program of the waterproof pillow with audio unit and the audio devices; and a first display unit, coupled with the controller, displaying the wireless communication link of the first wireless module and the second wireless module between the sound unit and the audio devices, displaying a communication link between the transceiving module of the sound unit and the remote control unit, and displaying a power status of the sound unit.

11. The waterproof pillow with audio unit of claim 1, wherein the remote control unit further comprises a second display unit for remotely displaying a wireless communication link of the first wireless module and the second wireless module between the audio devices and the sound unit, remotely displaying a communication link between the transceiving module of the communication module and the remote control unit, and remotely displaying a power status of the sound unit.

12. The waterproof pillow with audio unit of claim 1, wherein the first type of audio devices is selected from one group consisting of a MP3 player and an IPOD player, and the second type of audio devices is selected from one group consisting of a mobile phone and a notebook computer.

13. The waterproof pillow with audio unit of claim 12, wherein when one of the MP3 player, the IPOD player, the mobile phone and the notebook computer plays the musical sound and the mobile phone rings, the sound unit stops to play the musical sound of the selected audio device and the switch unit switches from the musical playing mode of the selected audio device to a talk mode of the mobile phone for talking over the mobile phone, and when the talk mode is over, the switch unit switches from the talk mode of the mobile phone back to the musical playing mode of the selected audio device for continuously playing the musical sound.

14. The waterproof pillow with audio unit of claim 13, wherein when the mobile phone rings, the mobile phone corresponds to the sound unit by the first wireless module for establishing the talk mode so that the user utilizes the audio input device of the sound unit to talk with a calling party.

15. The waterproof pillow with audio unit of claim 12, wherein the sound unit utilizes the device-scanning module to identify one of the first type of audio devices and one of the second type of audio devices identifies the sound unit so that the controller controls the switch unit to switch between the identified first type of audio device and the identified second type of audio device.

16. The waterproof pillow with audio unit of claim 1, wherein the remote control unit selects one of the audio devices after the device-scanning module scans the audio devices.

* * * * *